US005630909A

United States Patent [19]

LaRiviere

[11] Patent Number: 5,630,909

[45] Date of Patent: May 20, 1997

[54] PULP FLUFFING GAS CONTACTOR

[75] Inventor: Christopher J. LaRiviere, Hudson, N.H.

[73] Assignee: Beloit Technologies, Inc., Wilmington, Del.

[21] Appl. No.: 335,282

[22] Filed: Nov. 7, 1994

[51] Int. Cl.[6] ..... D21C 1/10; D21C 9/153; D21D 5/20

[52] U.S. Cl. ..... 162/243; 162/57; 162/65; 366/303; 366/304; 366/305; 366/307

[58] Field of Search ..... 162/57, 23, 243, 162/65; 366/303, 304, 305, 307; 8/156; 241/28

[56] References Cited

U.S. PATENT DOCUMENTS 3,293,117 12/1966 Pennington et al. ..... 162/243
4,303,470 12/1981 Meredith et al. ..... 162/57

*Primary Examiner*—Steven Alvo
*Attorney, Agent, or Firm*—Dirk J. Veneman; Raymond W. Campbell

[57] ABSTRACT

A guide vane is provided in a pin fluffer to assist in pulp mat retention during fluffing by providing a cyclic lift component to the mat as it passes over the vane thereby also further increasing retention time obtained in the fluffer.

19 Claims, 4 Drawing Sheets

PULP FLUFFING GAS CONTACTOR

BACKGROUND OF THE INVENTION

This invention relates generally to pulp manufacturing processes and equipment, and more particularly to an apparatus for fluffing high consistency pulp in the presence of a gaseous bleaching agent for promoting intimate contact between pulp and bleaching reagent.

Also, more particularly, the present invention relates to a means of manipulating wood pulp fibers within a rotary pin type fluffer to extend the fluffing time in the presence of a gaseous bleaching agent.

As is known, wood pulp is obtained from the digestion of wood chips, from repulping recycled paper, or from other sources and is commonly processed in pulp and paper mills in slurry form in water. Recently there have been many efforts to use ozone as a bleaching agent for high consistency wood pulp. Although ozone may initially appear to be an ideal material for bleaching lignocellulosic materials, the exceptional oxidative properties of ozone and its relatively high cost in the past have limited the development of satisfactory devices.

The primary characteristic of pulp slurries which changes with the consistency of the slurry is the fluidity. Wood pulp in the high consistency ranges (above 18–20% oven-dry consistency) does not have a slurry like character, but is better described as a damp, fibrous solid mass. High consistency pulp can be fluffed, in the same way that dry fibrous solids such as cotton or feathers can be fluffed, to give the pulp a light and porous mass, the inner fibers of which are accessible to a chemical reagent in gaseous form.

The characteristic of compressibility of fluffed pulp, however, makes it difficult to move or transport in conventional solids bulk handling equipment without increasing the bulk density and reducing the porosity (void volume).

To realize fully the advantages of the gas phase reaction in a multistage bleaching of cellulosic fibrous pulp, the comminution of the pulp to produce the fluffed pulp must be of a specific nature so as to produce fragments which independent of their size are of low density, and of porous structure throughout and substantially free from any highly compressed portions, i.e., compacted fibre bundles. Only when this form of comminuted pulp is achieved can the gaseous reactants reach all parts of the comminuted pulp fragments, and thus ensure that the reaction of the gaseous reagent with the fluffed pulp proceeds rapidly and uniformly. The concern for uniformity of contact between the fluffed pulp and the bleaching reagent gas, in the case of ozone bleaching, is fostered by the rapid reduction in the concentration of ozone gas in contact with the fluffed pulp. This reduction is attributable to the extremely fast reaction rate of ozone with wood pulp. Since the reaction rate is concentration dependent, this characteristic increases the non-uniform bleaching results attendant upon the variable permeability of the pulp.

As described hereinabove, the fluffed pulp mass is easily compressed by the action of bulk solids handling equipment to form wads and clumps having much higher density and much lower gas permeability. Bleaching gas flows much more slowly through such wads and clumps and much more rapidly through the wad-to-wad contact areas. The result is overbleached contact areas and underbleached wad cores. Thus, it has been found that bleaching systems which employ conventional bulk materials handling equipment to move high consistency fluffed pulp through a bleaching retention chamber while bleaching it with ozone gas cannot successfully produce uniformly bleached pulp fiber.

Pin shredders and fluffers are used in pulp and paper manufacture and in many other industries for shredding sheet material or fluffing fibrous materials. The size of the particle produced by such a pin shredder depends on several factors such as the size and spacing of the pins, the speed of rotation, retention time, and housing clearance.

An example of such a machine is a fluffer used in high consistency bleaching experiments, and which is described in U.S. Pat. No. 3,725,193 to De Montigny. However, while this machine, and other similar machines, may have operated with varying degrees of success, these machines suffer from a plurality of shortcomings which have detracted from their usefulness.

For example, a disadvantage of using a screen (as suggested in De Montigny) to retain the coarse particles within the housing arises from the fibrous and floccular nature of moist wood pulp. For the flocs to pass through screens, the apertures or slots must be undesirably large, which will result in permitting unfluffed particles of similar size to pass.

Another class of known pin rotor machines used in pulp and paper manufacture consists of a cylindrical housing containing stationary pins on the inside which interleave with pins disposed on a rotor. Such high speed pin rotor machines have operated with varying degrees of success in the low to medium consistency ranges for processing wood pulp, for example as a steam mixer. However, these machines do not operate satisfactorily when processing high consistency pulp, because at high consistency the pulp fibers cling to the base of the stationary pins as they are thrown against them by the rotating pins and by the centrifugal forces of the rotating pulp mass, and the fibers build up to form a plugging condition in the housing, impeding thru flow of the wood pulp being processed.

The foregoing illustrates limitations known to exist in present machines for fluffing and manipulating high consistency wood pulp. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluffing contactor comprising a cylindrical shell having a solids inlet adjacent one end and a solids outlet adjacent an opposite end and a gaseous reagent inlet for introducing the reagent into the shell; a cylindrical rotor mounted for rotation within the shell of sufficient diameter to form a restricted annular space of convenient axial length; the rotor being further provided with a plurality of pinlike radially extending projections for imparting a circumferential swirl to solid fibrous material introduced within the shell; the shell being further provided with a plurality of guide foils projecting into the annular space intermediate the rotary paths subscribed by the pinlike projections and oriented generally parallel to the rotary paths for a first combing portion and at an accurate angle to the rotary paths for a second axially directing portion.

Also, in accordance with the present invention, a method is provided for optimizing the reaction between a gaseous bleaching reagent and a volume of high consistency wood pulp by fluffing the pulp in the presence of the reagent gas for a sufficient period of time to assure the production of good fluff which has been intimately contacted with the reagent gas by the repeated mechanical action of the fluffer in an extended action path.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

A rotary pin type fluffer contactor has been described in patent application No. 08/125,053 assigned to the same Assignee as the present invention. A vertical axis version (shown in FIG. 1) uses a conical surface to control the motion of the fibers passing through the machine.

Figure 1:
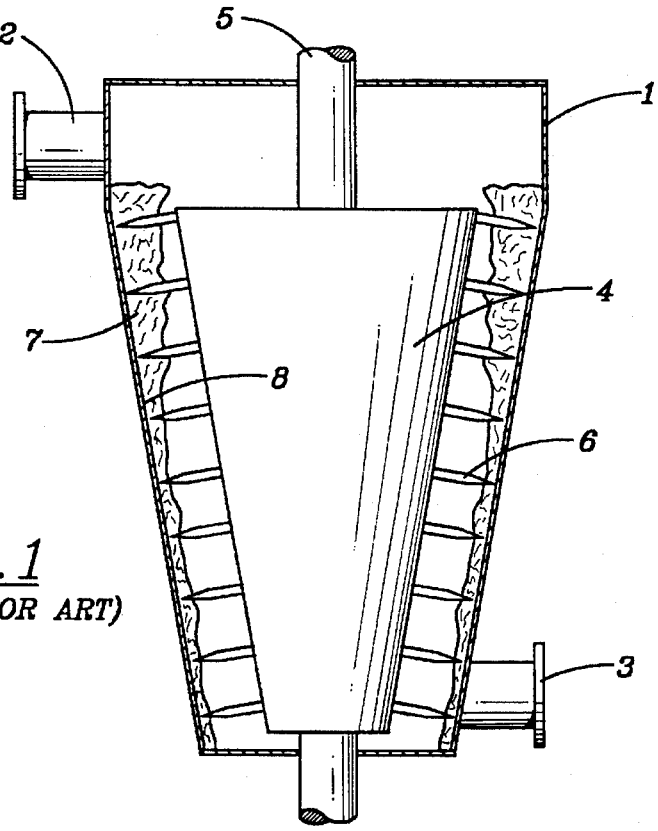
FIG. 1 (PRIOR ART)
FIG. 1 is a sectional view of an apparatus according to the prior art and wherein an apparatus housing is illustrated in section to expose a pin rotor rotatably mounted therein.

As shown in FIG. 1, the fluffer is comprised of a generally conical housing 1 having an inlet 2 and an outlet 3 for receiving and discharging pulp fiber respectively. A pin rotor 4 is shown which is also generally conical in section and is mounted for rotation within the housing 1 on a shaft 5 which extends through the housing. The rotor is further provided with a plurality of pinlike projections 6 which extend from the rotor to a point proximate the internal wall of the housing.

Pulp fibers enter the machine through inlet 1 where they are then caused to be spun about the circumference of the machine by the combing action of the rotor 4 and pins 6. The centrifugal force of the pulp fiber mat 7 acting against the conical surface 8 causes the downward motion of the pulp fiber mat due to gravity to be retarded in a vertical machine. This conical surface also can be used to provide a means of traversing the pulp fibers through a horizontal machine.

For a given rate of rotation of the pulp fiber mat and a given radius of rotation, there is a conical angle of the housing that will cause an upward force on the pulp mat just equal to the downward force of gravity. To achieve a controlled downward flow of pulp the rotational speed of the rotor is adjusted to a slightly slower value than the "equilibrium" speed. This is a delicate balance, and in practice the downward velocity increases toward the bottom of the housing as the radius gets smaller, so that the mat thickness becomes thinner as shown in FIG. 1.

There is a maximum thickness of pulp mat which can be properly agitated and fluffed by a pin rotor. An uneven pulp mat causes the fluffer to be inefficiently loaded resulting in the need for a larger and less economical machine. The conical shape of the machine is not space efficient.

Figure 2:
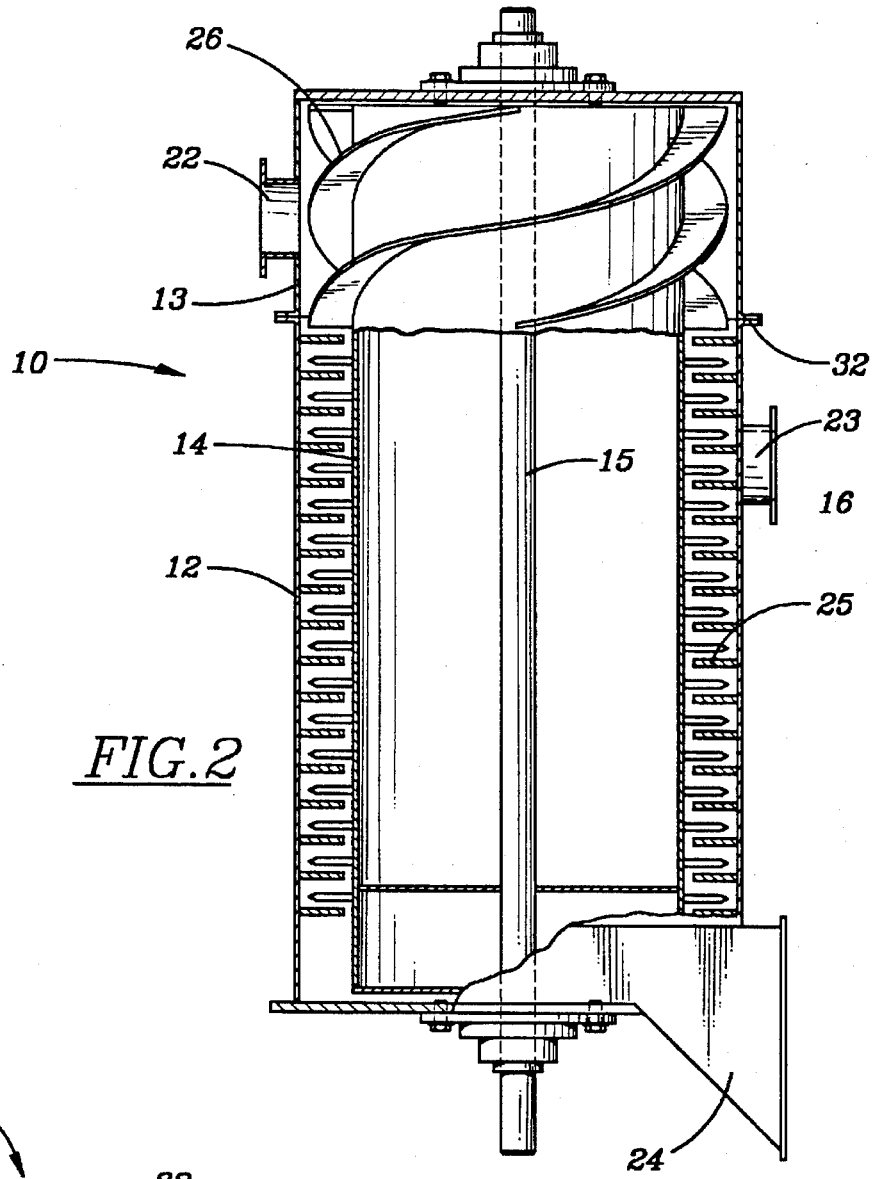
FIG. 2 is a cross-sectional view of an embodiment of the apparatus of the present invention.
Figure 3:
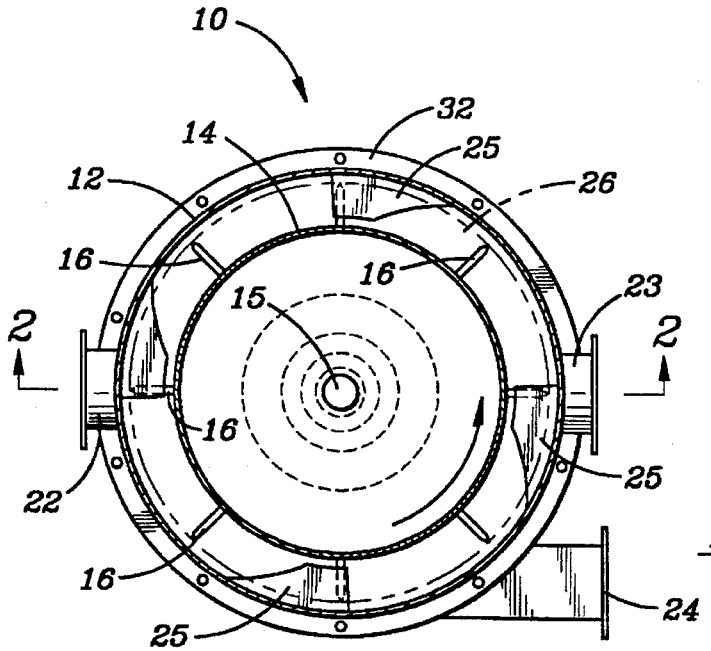
FIG. 3 is a cross-sectional view of an embodiment of the apparatus of the present invention taken at section 3—3 of FIG. 2.

FIGS. 2 and 3 illustrate a contemplated commercial embodiment of the apparatus 10 which is designed for continuously fluffing a high volume of high consistency wood pulp and for continuously promoting intimate contact between the high consistency pulp and a gaseous bleaching reagent. The housing is formed in two parts by a lower housing 12 and an upper housing 13 joined by an assembly flange 32. The upper housing 13 receives a continuous stream of high consistency wood pulp from a feeding and gas seal forming assembly device which compacts the high consistency wood pulp into a gas tight plug. The plug is introduced in the fiber inlet 22. A pin rotor shaft 15 rotatably supports and drives a pin rotor drum 14. The upper portion of the pin rotor drum 14 is provided with a helical formed shredder 26 having teeth like surfaces (not shown) around the outer periphery which break up the plug into small pieces and convey them into a fluffing and contacting zone in the lower housing 12.

The helical formed shredding elements 26 also impart an internal circumferential velocity to the pulp particles. The pin 16 tips comb through the annulus of pulp which forms against the interior housing surface. The action of the pin rotor and pins 16 on the pulp fiber mat causes the mat to rotate and behave as a fluidized solid as it begins to fluff.

A series of guide foil 25 according to the present invention is used to control and direct the motion of the fluidized pulp fiber mat thus formed. The rows of guide foils also provide another surface for combing of the pulp mat which increases fluff quality. Additionally, any bridging of pulp fibers between adjacent rotor pins 16 is cleared by the guide foils.

Figure 5:
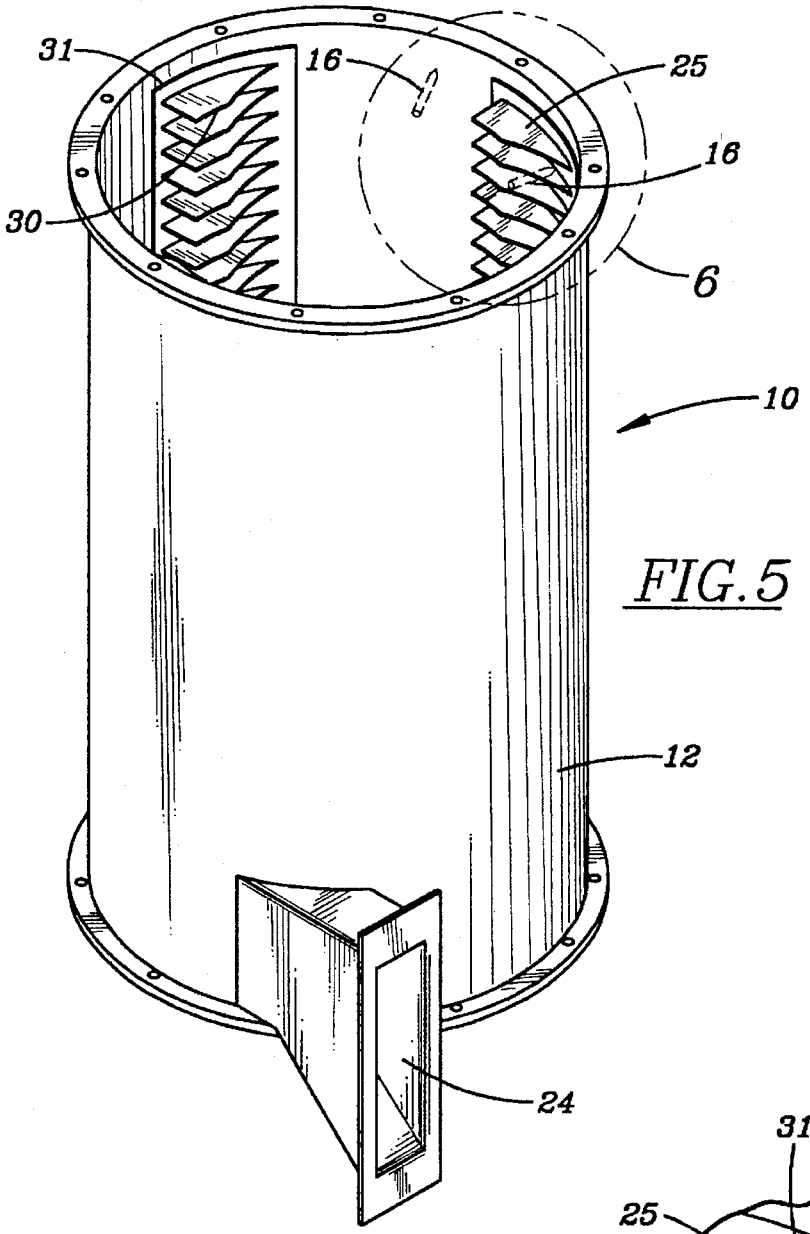
FIG. 5 is a pictorial isometric illustrating one possible embodiment of the apparatus of FIGS. 2 and 3, illustrating the longitudinally disposed guide vanes formed on the housing interior.
Figure 6:
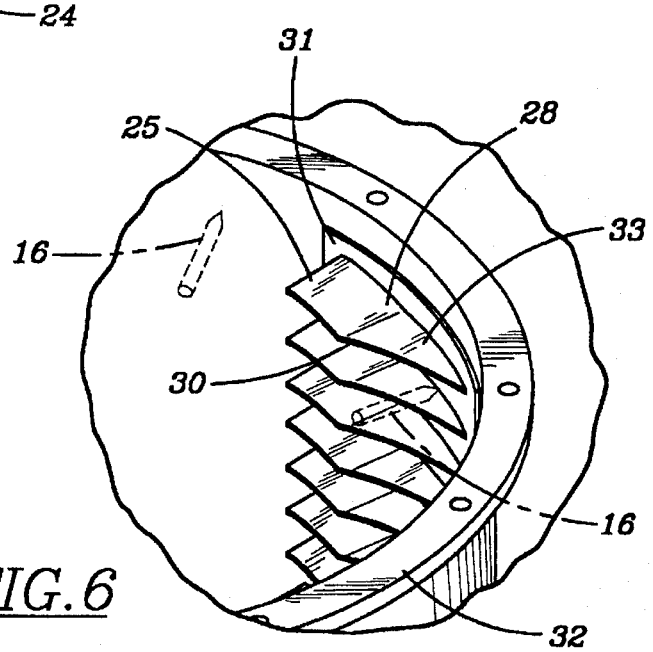
FIG. 6 is an enlarged pictorial isometric view of an embodiment of the apparatus of the present invention taken in the area indicated on FIG. 5.

The guide foil consists of a flat "mat immersion" surface 33 followed by a lifting surface or tab 28. The guide foils may be disposed about the internal peripheral surface in an arrangement as shown in FIG. 5 wherein a number of the guide vanes are mounted to a mounting plate 31 and aligned in an axially vertical arrangement to intercept the circumferentially induced flow of the fluffed pulp fiber mat.

The thus induced and controlled advance turbulent circumferential flow progresses under the force of gravity from the inlet 22 to the outlet 24. A reactant gas may be added at gas inlet 23 resulting in a turbulent mixture of gas and pulp for an extended circumferential path through the fluffer. The gas contact during fluffing results in extremely rapid and thorough gas contact with individual fibers thereby allowing reaction to take place in a most efficient manner.

Figure 7:
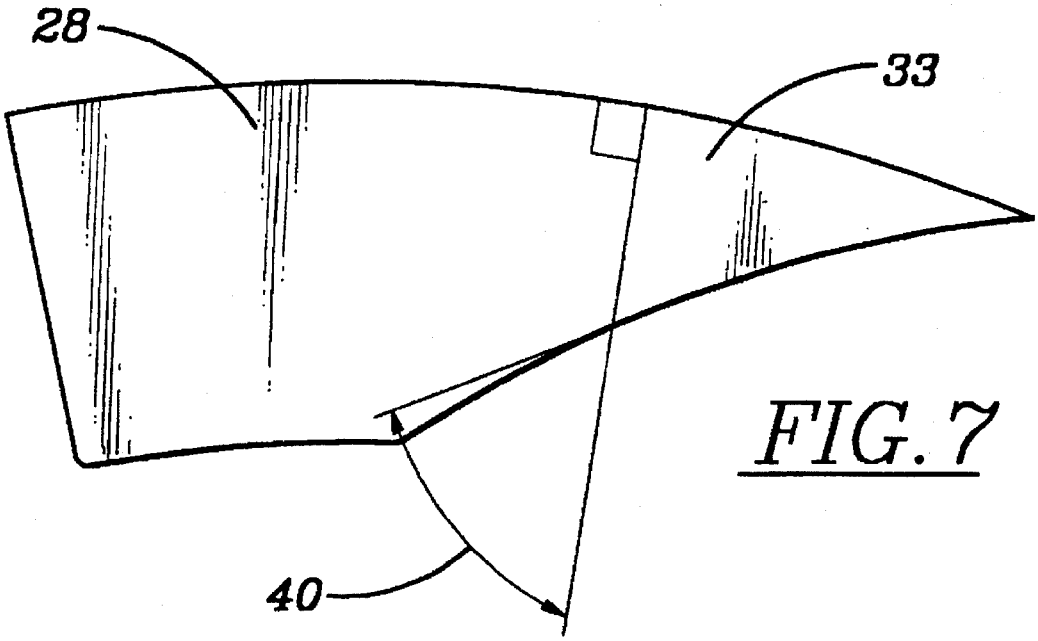
FIG. 7 is a plan view of a guide foil according to the present invention.
Figure 8:
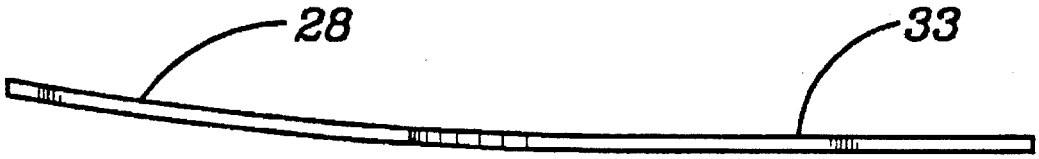
FIG. 8 is an edge elevation view of a guide foil according to the present invention.

As shown in FIG. 7 and FIG. 8, a leading edge 30 is provided on each guide foil which is set at a shallow inwardly diverging angle 40 (typically 60 degree to the radial line intersection as shown in FIG. 7) to both retard the development of plugs and to promote the shedding of fiber buildup that would otherwise develop on a square leading edge. The precise angle of the lead edge is selected to provide sufficient surface interruption to assure the combing and shredding action effected by the rotating pins.

In addition, the guide foils 25 are used to control and direct the motion of the fluidized pulp mat in its circumferential path about the interior of the housing. This is accomplished by providing each guide foil with a flat mat immersion surface 33, followed by a lifting surface or tab 28 which acts substantially in the nature of an aircraft wing elevator or aileron by imparting a slight lift to the direction of the flowing mat between rows of guide foils. As the pulp mat slides pass the guide foils an upward velocity is imparted.

The mat continues to travel around the interior circumferential surface of fluffer housing 12 while the upward component of the velocity is dissipated by gravity and the mat begins to drop. The mat accelerates downward and reaches a vertical distance just below the point where it was lifted by the first foil.

At this point another guide foil will lift the mat repeating the process. This parabolic motion of the pulp fiber mat in the vertical orientation is repeated along the length of the machine. The guide foils allow the fluffer to be cylindrical rather than conical which apart from the advantage outlined above, result in a machine that has a lifting mechanism that does not change with the length of the machine. This results in a constant lifting force and thus a constant rate of thruput and mat thickness.

A preferred circumferential spacing of between 12 and 20 inches between guide foils has been utilized with a wider range also proving useful. Forming the lifting surface upward about a 30 inch radius for a length of 2 to 3 inches has proved effective in test apparatus. A four (4) inch mat thickness spacing between the drum 14 and the inner surface of the drum 12 has also proven effective. The above dimensions will vary depending on equipment size, speed of rotation of the drum, degree of fluffing required and desired retention time.

It should also be appreciated by one skilled in the art that any desirable degree of lifting can be achieved in any section of the vessel. For example greater lift may be effected at the top of the vessel during acceleration and a reduction of lift accomplished in the lower portion of the vessel as the volume of fluff mat increases due to the fluffing action involved. During operation of the apparatus 10 the annulus of high consistency wood pulp mat moves axially through the housing. This may be accomplished by a variety of techniques, for example, in the vertical orientation, gravity accomplishes the movement. In orientations other than vertical, the guide vanes may be used to either assist or retard the flow in a particular direction as may be required.

Additionally, axial movement of the pulp may be achieved by using the flow of a gaseous bleaching chemical introduced, for example, in inlet 23 to blow the fluff pulp through the housing. These actions, of course, will work in conjunction with the guide vane to produce and control the flow through the housing thereby producing a fluffed pulp having traversed through an elongated essentially parabolically varying spiral path progressing through the fluffer from inlet to outlet. This action, in fact, in the presence of a reagent gas produces an intimate mix of the reagent gas with the pulp being fluffed for a sufficient time for substantial portions of the reaction to occur as, for example, the reaction that occurs when ozone gas, chlorine gas, or peroxide gas is utilized as a bleaching agent. The intimately mixed gas and fiber may thereafter be conveyed to a degasification vessel wherein the gas reagent may be effectively separated.

In the prior art one method for accomplishing separation is a fixed bed device wherein the pulp bed is allowed to compact and thereby assist in the pressing out of the residual reacting gas. This type of vessel has also proved to be an effective and efficient device for allowing the intimately contacted reactant gas to complete its reaction without mechanical induced fiber degradation.

Figure 4:
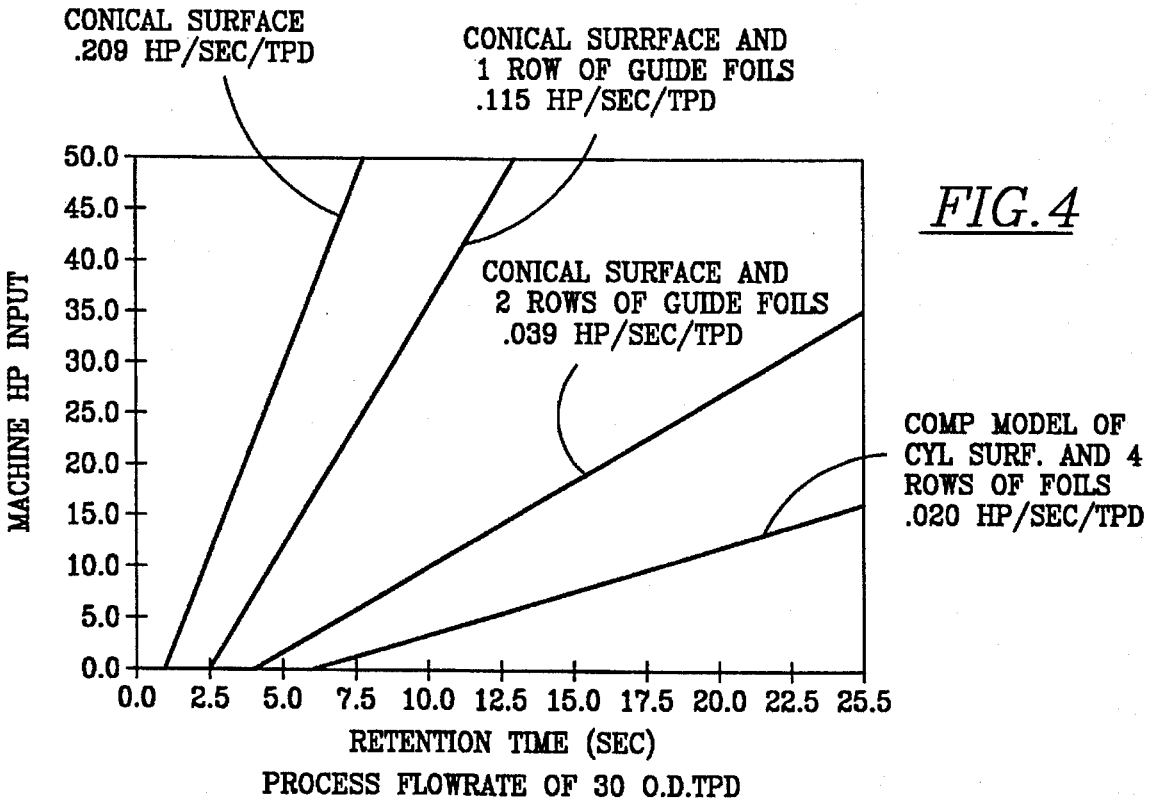
FIG. 4 is a plot of pilot plant results showing the increase in retention time for a given power input for the present invention vs. the conical surface of the prior art.

FIG. 4 shows the substantial increase in retention time effected by a device according to the present invention as compared to a device having a conical surface only, for example, for a given horsepower.

High retention time for a given Hp is important for several reasons. It has been found in the laboratory that a total energy input into the pulp of 0.4 Hp/O.D.TPD is sufficient to create good quality fluff as measured by image analysis. Increasing the total input energy results in little additional fluff quality and can cause fiber damage and high machine wear rates. Low energy transfer rates result in a preferred, gentle combing action. High total energy input also increases the pulp stream discharge temperature which is detrimental to the bleaching process.

In the pilot plant using a two degree cyclone the effectiveness of the guide foils was readily apparent showing increases in retention time of, for example, 4 to 7 seconds and a decrease in energy transfer rate of 0.209 to 0.115 Hp/sec/O.D.TPD for a single row of guide foils. Two rows of guide foils cause a still larger increase in retention time and a corresponding decrease in energy transfer rate. Analytical models based on pilot plant results predict that a cylindrically shaped machine with 4 rows of guide foils will result in energy transfer rates of 0.02 Hp/sec/O.D.TPD which gives a total energy input of 0.4 Hp/O.D.TPD which gives a total energy input of 0.4 Hp/O.D.TPD at 20 seconds retention time.

While this invention has been illustrated and described in accordance with a preferred embodiment, it is recognized that variations and changes may be made therein without departing from the invention as set forth in the following claims:

What is claimed is:

1. A pulp fluffing contactor comprising:

a cylindrical shell having a solids inlet adjacent one end and a solids outlet adjacent an opposite end and a gas inlet for introducing a gas into said shell;

a cylindrical rotor mounted for rotation within said shell of sufficient diameter to form a restricted annular space of convenient axial length;

said rotor being further provided with a plurality of radially outward extending projections subscribing a rotary path for imparting a circumferential swirl to solid fibrous material introduced within the shell;

said shell being further provided with a plurality of guide foils projecting into said annular space intermediate the rotary paths subscribed by said projections and oriented generally parallel to said rotary paths;

said guide foils further comprise a first combing portion and a second axially directing portion set at an accurate angle to said rotary paths for axially directing said circumferential swirl; and a leading edge of each guide foil being set at an inwardly diverging angle from a surface of the foil attached to the cylindrical shell and the second foil surface being structured to impart a slight lifting as the pulp flows past the surface.

2. A fluffing contactor according to claim 1, wherein: said plurality of guide foils projecting to said annular space wherein said first combing portion is further provided with a leading edge set at an angle so as to both intercept the circumferential swirl introduced within the shell and to deflect pulp particles intercepting said leading edge.

3. A fluffing contactor according to claim 1, wherein: said arcuate angle to said rotary path for a second axially directing portion of said guide foils are set at an angle to control axial advancement of said circumferential swirl of solid fibrous material introduced within said shell.

4. A fluffing contactor according to claim 1, wherein: said projections are pins.

5. A fluffing contactor according to claim 1, wherein: said gas is a reagent gas.

6. A fluffing contactor according to claim 5, wherein: said reagent gas is a bleaching gas.

7. A fluffing contactor according to claim 1, wherein: said restricted annular space is in the order of 2 to 10 inches in depth.

8. A fluffing contactor according to claim 7, wherein: said restricted annular space is approximately 6 inches in depth.

9. A fluffing contactor according to claim 1, wherein: said projections extend substantially through said restricted annular space.

10. A fluffing contactor according to claim 1, wherein: said guide foils extend substantially through said restricted annular space.

11. A fluffing contactor according to claim 1, wherein: said guide foils first combining portion is further provided with a leading edge set at a shallow inwardly diverging angle.

12. A fluffing contactor according to claim 11, wherein: said shallow inwardly diverging angle is approximately 60 degrees to a radial line intersection.

13. A fluffing contactor according to claim 1, wherein: said second axially directing portion of said guide foils comprises an axially offset tab extension of said first combing portion.

14. A fluffing contactor according to claim 13, wherein: said axially offset tab extension is formed upward at approximately a 30 inch radius.

15. A fluffing contactor according to claim 13, wherein: said axially offset tab extension is formed upward at a determined angle to provide a compensating lift from inlet to outlet to increase residence time in said contactor.

16. A fluffing contactor according to claim 15, wherein: said axially offset tab extension is formed upward at an angle to promote flow.

17. A fluffing contactor according to claim 15, wherein: said bleaching gas is a mixture of ozone and oxygen.

18. A fluffing contactor according to claim 1, wherein: said guide vanes are set apart circumferentially between 12 and 20 inches on said shell.

19. A pulp fluffing contactor comprising:

a vertically orientated cylindrical shell having a solids inlet adjacent a top end and a solids outlet adjacent a bottom end and a gas inlet for introducing a gas into said shell;

a cylindrical rotor mounted for rotation within said shell of sufficient diameter to form a restricted annular space of convenient axial length;

said rotor being further provided with a plurality of radially outward extending projections subscribing a rotary path for imparting a circumferential swirl to solid fibrous material introduced within the shell;

said shell being further provided with a plurality of guide foils projecting into said annular space intermediate the rotary paths subscribed by said projections and oriented generally parallel to said rotary paths;

said guide foils being further provided with a leading first combing portion oriented substantially parallel to said rotary paths and a second trailing portion set at an accurate angle to said rotary paths providing an axially directing portion; and a leading edge of each guide foil being set at an inwardly diverging angle from a surface of the foil attached to the cylindrical shell and the second foil surface being structured to impart a slight lifting as the pulp flows past the surface.

* * * * *